US008303101B2

(12) United States Patent
Innes

(10) Patent No.: US 8,303,101 B2
(45) Date of Patent: Nov. 6, 2012

(54) APPARATUS FOR PRINTING ON A MEDIUM

(75) Inventor: Eric M. Innes, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 263 days.

(21) Appl. No.: 12/837,349

(22) Filed: Jul. 15, 2010

(65) Prior Publication Data

US 2012/0013692 A1 Jan. 19, 2012

(51) Int. Cl.
*B41J 2/01* (2006.01)
*B41J 11/00* (2006.01)

(52) U.S. Cl. ..... 347/102; 400/579

(58) Field of Classification Search ..... 347/102; 400/579

See application file for complete search history.

(56) References Cited

U.S. PATENT DOCUMENTS

| | | | | |
|---|---|---|---|---|
| 4,546,964 | A * | 10/1985 | Linthout | 271/250 |
| 5,179,896 | A | 1/1993 | Copeland | |
| 5,248,210 | A | 9/1993 | Schulz | |
| 5,420,621 | A | 5/1995 | Richtsmeier et al. | |
| 5,460,457 | A * | 10/1995 | Mindler et al. | 400/579 |
| 2009/0060548 | A1 | 3/2009 | Souda | |
| 2009/0195628 | A1 | 8/2009 | Innes | |
| 2009/0231389 | A1 | 9/2009 | Ishitoya et al. | |

FOREIGN PATENT DOCUMENTS

JP 2007008598 A 1/2007

* cited by examiner

*Primary Examiner* — Stephen Meier
*Assistant Examiner* — Tracey McMillion

(57) ABSTRACT

A roller assembly for use in a printer includes a shaft with two ends and a pair of conical rollers. Each of the conical rollers is disposed on the shaft near each of the ends. The roller assembly guides a medium within the printer without damaging a freshly-printed surface of the medium. A printer including the roller assembly and a belt in contact with the roller assembly is also described and claimed.

20 Claims, 3 Drawing Sheets

APPARATUS FOR PRINTING ON A MEDIUM

BACKGROUND

In a printer or other type of paper handler, the paper or medium may move through the printer along a media path using a combination of belts and rollers. Various arrangements of belts and rollers may wrinkle or otherwise damage the paper. In other instances, the belts and rollers may contact freshly-printed surfaces and damage the printed image.

Figure 1:
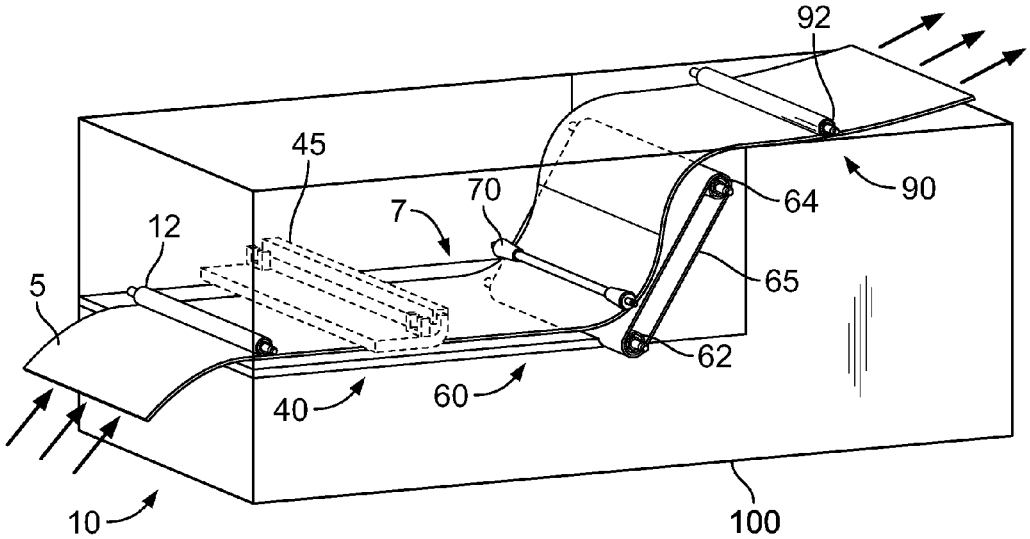
FIG. 1 is a conceptual illustration of a printer according to embodiments of the invention.

Where considered appropriate, reference numerals may be repeated among the drawings to indicate corresponding or analogous elements. Moreover, some of the blocks depicted in the drawings may be combined into a single function.

DETAILED DESCRIPTION

In the following detailed description, numerous specific details are set forth in order to provide a thorough understanding of embodiments of the invention. However, it will be understood by those of ordinary skill in the art that the embodiments of the present invention may be practiced without these specific details. In other instances, well-known methods, procedures, components, and circuits have not been described in detail so as not to obscure the present invention.

Embodiments of the present invention may be used in a variety of applications. Although the present invention is not limited in this respect, the techniques disclosed herein may be used in paper handling machines such as inkjet and laser printers, photo printers, multi-function printers, copiers, presses, and the like.

Printed images or impressions on a freshly-printed surface on a medium (such as paper or cards) may be damaged by rollers used to advance or guide the medium through the printer. Embodiments of the invention may provide an apparatus and techniques that minimize such damage. Such embodiments may include a roller assembly having a set of conical rollers that are tapered such that the paper may be contacted just at the edges.

Figure 2:
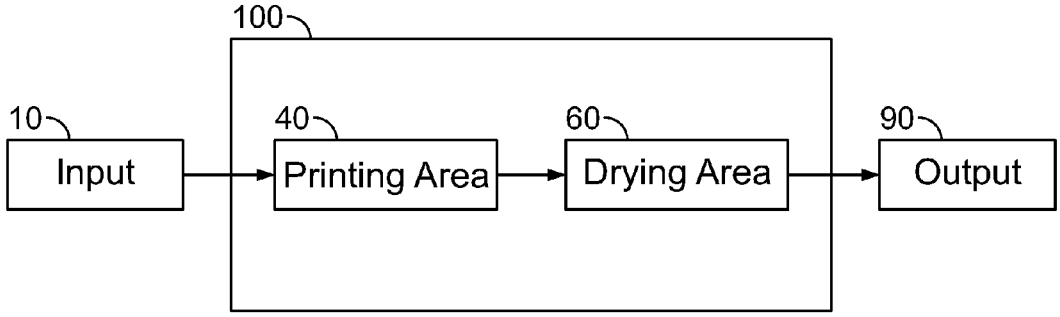
FIG. 2 is a block diagram of the workflow of a printer according to embodiments of the invention.

Reference is now made to FIGS. 1 and 2, which are, respectively, a conceptual illustration of a printer 100 and a block diagram of the workflow of the printer according to embodiments of the invention. Printer 100 may include input area 10, printing area 40, drying area 60, and output area 90, among other areas. Medium 5 may be fed into input area 10, in which there may be one or more rollers 12. Printing, imaging, or otherwise making an impression onto medium 5 may occur in printing area 40. Printing area 40 may include imager 45, which may be a drum, one or more ink cartridges attached to a belt drive, or ink cartridges providing ink to a carriage, depending upon which type of printer 100 is, e.g. an inkjet printer, a photo printer, a laser printer, a copier, a multi-function printer, etc. Medium 5 is fed or guided along media path 7 to drying area 60 and then may exit the printer through output area 90, which may include one or more rollers 92.

The parts and blocks shown in FIGS. 1 and 2 are examples of parts that may comprise printer 100 and its workflow, and do not limit the parts or modules that may be part of or connected to or associated with printer 100.

Figure 3:
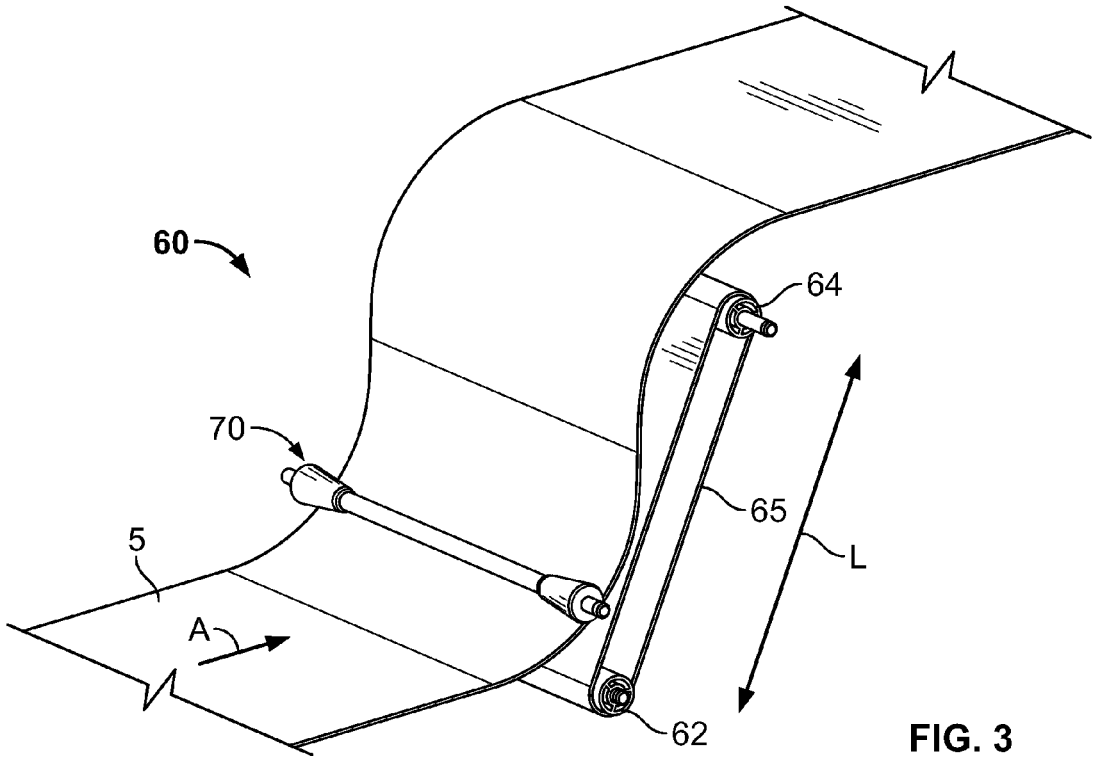
FIG. 3 is a conceptual illustration of a drying area of a printer according to embodiments of the invention.

A conceptual illustration of drying area 60 is shown in FIG. 3. Freshly-printed medium 5 may exit printing area 40 and may be guided in between roller assembly 70 and belt 65 from left to right in FIG. 3. Belt 65 may advance using rollers 62, 64. Roller assembly 70, shown in more detail in FIG. 4, may include shaft or axle 74 and conical rollers 72. Belt 65 may be a flat conveyor belt, which may be minimally tensioned such that low normal force may cause the belt to deflect. Belt 65 may be an endless belt formed from a continuous band, or a straight piece with its two ends joined together.

Figure 4:
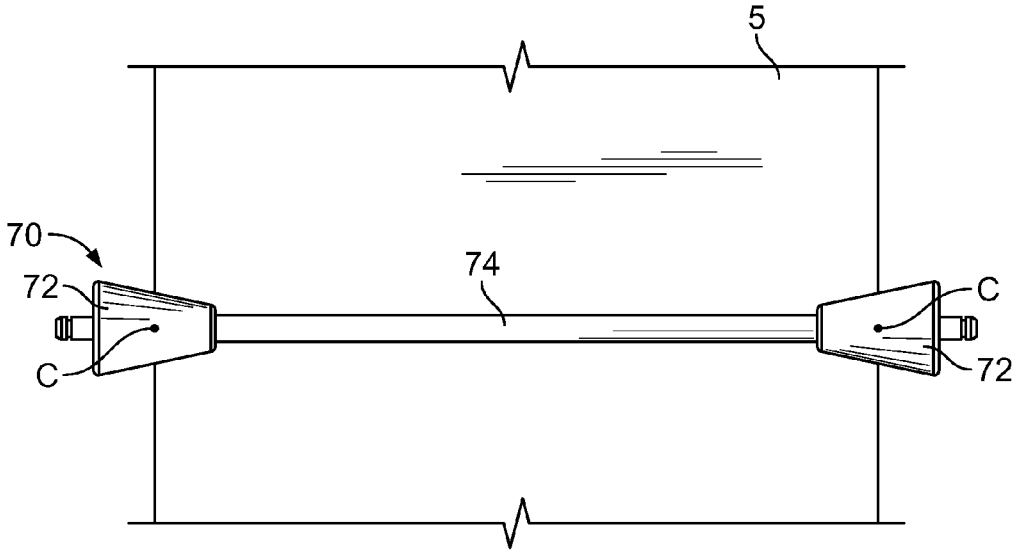
FIG. 4 is a conceptual illustration of a roller assembly of a printer according to embodiments of the invention.

Reference is now made to FIG. 4, which is a conceptual illustration of roller assembly 70 guiding medium 5 according to embodiments of the invention. Conical rollers 72 may be disposed near the ends of shaft 74 and typically are fixed with respect to the shaft (i.e., they do not move parallel or along shaft 74). Since rollers 72 are conical, they are tapered such that each one nominally contacts medium 5 at one place—the edge of the medium, not on the freshly-printed surface itself. (This may be seen more clearly in FIG. 6.) Conical rollers 72 may be designed to be placed on the shaft so that their centers C are as far apart as the typical width of medium 5, for example 4 inches (10 cm) for a 4"×6" photo card, or 8.5 inches (~21.25 cm) for 8.5"×11" letter-sized paper. Roller assembly 70 may then be effective at guiding media having a range of widths such that both media edges are capable of contacting the rollers.

Roller assembly 70 can guide medium 5 in two typical types of printer arrangements—edge-justified and center-justified. Justification refers to the position of the medium relative to the printer's media path as the medium travels through the printer. Edge-justified refers to a medium traveling though the printer contacting a guide on one edge. Center-justified refers to a medium that travels through the printer centered between the edges of the printer. In center-justified printers, roller assembly 70 can help to self-center medium 5 while it travels through printer 100.

Typically, the image on the medium as it exits printing area 40 may still be wet. Thus, even though conical rollers 72 nominally contact medium 5 at the edges, it is advantageous to use non-stick roller material, at least on the outer surface of the roller. Several Teflon®-based materials are good for this: Teflon® itself (polytetrafluoroethylene or "PTFE"), Teflon-FEP, sometimes called simply "FEP" (for fluorinated ethylene propylene), and Teflon-PFA, sometimes called simply "PFA" (for perfluoroalkoxy). Teflon-FEP and PFA are also easy to injection mold into rollers. Delrin® (polyoxymethylene, also known as "POM," polyacetal, or polyformaldehyde), made by DuPont, is less expensive than Teflon®-based materials, is relatively non-stick, and can be injection molded into rollers. These materials are listed in descending order of non-stickiness.

Figure 5:
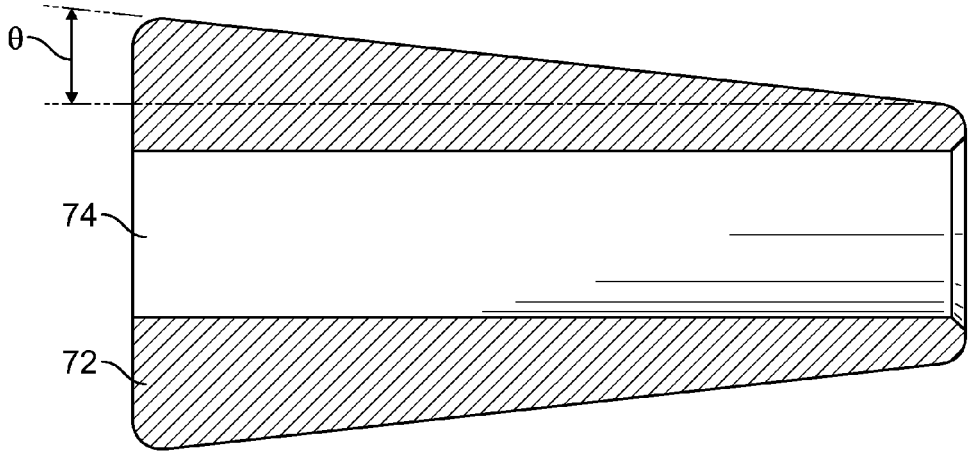
FIG. 5 is a conceptual illustration of a conical roller in a roller assembly of a printer according to embodiments of the invention.

Reference is now made to FIG. 5, which is a conceptual illustration of conical roller 72 in roller assembly 70. The taper angle can help to handle various media types and to self-center the medium. An angle θ~5-10° is shown in FIG. 5; typical taper angles may range from 5° to 40°, with a preferred range of 10° to 30°. Having a larger taper angle allows the roller assembly to center and guide the medium better, but also tends to bend the medium more. Thus, larger taper angles may be better suited for stiffer media such as card stock and photo paper, and smaller cone angles may be better suited for more flexible media, such as paper. Also, selecting a flatter cone profile (smaller taper angle) allows the printer to feed various media widths without requiring any machine reconfiguration.

Figure 6:
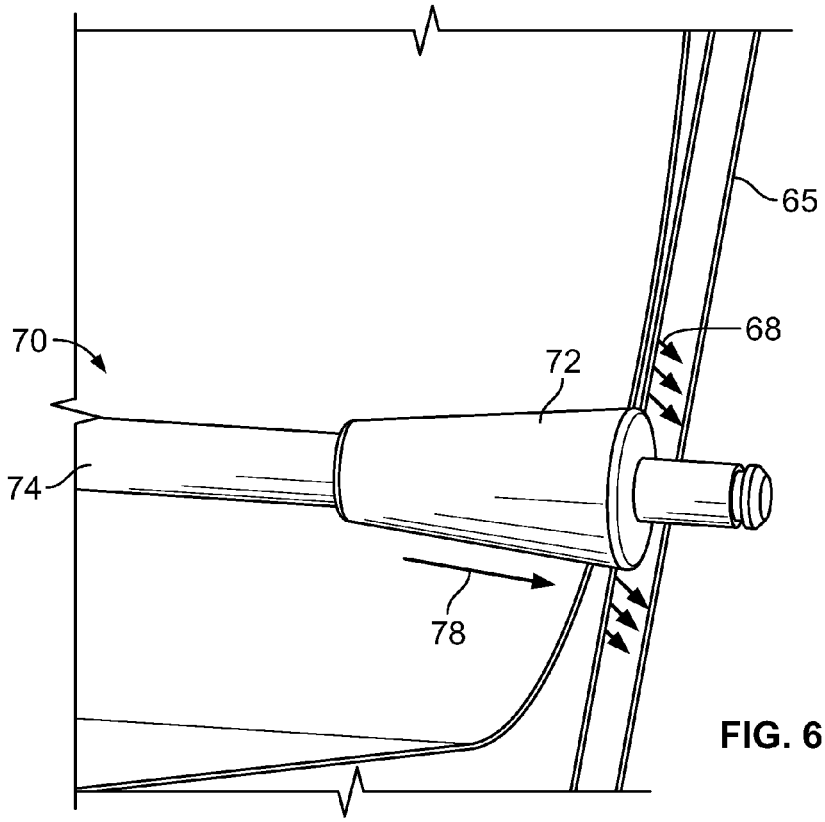
FIG. 6 is a magnified view of part of a roller assembly and a belt within a printer according to embodiments of the invention.

Reference is now made to FIG. 6, which is a magnified view of part of roller assembly 70 and belt 65. As described earlier, belt 65 may be placed under roller assembly 70, allowing medium 5 to be guided in between roller assembly 70 and belt 65. Belt 65 may be made of urethane, reinforced with polyester (or similar) manmade fibers. In some embodiments, belt 65 is not needed and is not included in printer 100, in which case conical rollers 72 may guide the medium.

If belt 65 is included in printer 100, one consideration in using it is the tension of the belt, which may typically be 15 to 20 Newtons. A low tension allows the medium to wander either left or right without excessive pinching or binding of the medium, which may result in damage to the freshly-printed surface. As the medium moves to the right side of the printer (see arrow 78), it may tend to get pushed further into the flat belt due to the conical roller. Because the belt may be set to a very low tension, it is sufficiently compliant such that the belt can move out of the way (see arrows 68) and minimize detrimental effects to the photo surface due to what could otherwise be excessive pinch force. The opposite effect may be true if the medium tends to move to the left side of the printer. A printer having flat rollers rather than conical rollers may not be capable of operating in this fashion.

If belt 65 is included in printer 100, another consideration may be where to place roller assembly 70 in relation to belt 65. If roller assembly 70 is located near rollers 62 or 64, there may too much resistance and not enough compliance. Locating the roller assembly toward the middle of the belt allows the roller assembly to move up and down more easily. Typical placement of roller assembly 70 in terms of belt length L may be one-quarter or one-third L (also called one-quarter or one-third span), or even one-half L (roller assembly 70 would be in the middle of the belt).

In sum, a roller assembly for use in printer is described that may be used to guide a freshly-printed medium through a printer without damaging the printed image. This may be accomplished by using conical rollers, which may be made of a non-stick material, that contact the medium only by the edges. The conical roller assembly may also self-center the medium as it travels through the printer, and is able to accommodate a range of media weights and widths.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

The invention claimed is:

1. A roller assembly for use in a printer, comprising:

a shaft having two ends; and a pair of conical rollers each of which is disposed on the shaft near each of the ends, said assembly for guiding a medium within the printer without damaging a freshly-printed surface of the medium, wherein the assembly is in contact with a belt in the absence of a medium.

2. The assembly of claim 1, wherein said assembly is configured to hold the medium without bending.

3. The assembly of claim 1, wherein said assembly is configured to self-center the medium.

4. The assembly of claim 1, wherein said rollers have a taper angle from about 5° to about 40°.

5. The assembly of claim 4, wherein said rollers have a taper angle from about 10° to about 30°.

6. The assembly of claim 1, wherein said rollers have an outer surface comprising a non-stick material.

7. The assembly of claim 1, wherein said rollers have an outer surface comprising a polytetrafluoroethylene-based material.

8. The assembly of claim 7, wherein said polytetrafluoroethylene-based material comprises polytetrafluoroethylene, fluorinated ethylene propylene, or perfluoroalkoxy.

9. The assembly of claim 1, wherein said rollers have an outer surface comprising polyoxymethylene.

10. A printer including:

a print area for printing on a medium;

a media path along which the medium can move out of the print area; and a roller assembly and a belt in contact with said roller assembly in the absence of a medium, wherein said roller assembly has a pair of conical rollers disposed on a shaft near ends of the shaft, said roller assembly for guiding the medium through the printer, along the media path and between said roller assembly and said belt.

11. The printer of claim 10, wherein said belt has a tension of between 15 and 20 Newtons.

12. The printer of claim 10, wherein said belt comprises urethane reinforced with polyester.

13. The printer of claim 10, wherein said belt comprises an endless belt.

14. The printer of claim 10, wherein said roller assembly is configured to hold the medium without bending.

15. The printer of claim 10, wherein said roller assembly is configured to self-center the medium.

16. An inkjet printer including:

an input area for receiving a medium for printing;

a printing area for receiving said medium from said input area and for producing an impression on said medium; and a drying area for receiving said impressed medium from said printing area, said drying area including a roller assembly having a pair of conical rollers disposed on a shaft near the ends of the shaft, wherein said roller assembly is configured for guiding said medium through the drying area to a printer output area for outputting said printed medium from said printer.

17. The inkjet printer of claim 16, wherein said drying area further includes a belt contact with said roller assembly in the absence of a medium, wherein said medium is guided between the conical rollers and the belt.

18. The inkjet printer of claim 17, wherein said belt has a tension of between 15 and 20 Newtons.

19. The inkjet printer of claim 16, wherein said conical rollers have a taper angle from about 5° to about 40°.

20. The inkjet printer of claim 16, wherein said conical rollers have an outer surface comprising a non-stick material.

* * * * *